US009070245B2

(12) United States Patent
Go

(10) Patent No.: US 9,070,245 B2
(45) Date of Patent: Jun. 30, 2015

(54) CASH BOX WITH A PARTIALLY PLATE-SHAPED CLOSING UNIT AND DEVICE FOR HANDLING NOTES OF VALUE

(71) Applicant: Wincor Nixdorf International GmbH, Paderborn (DE)

(72) Inventor: Florante Go, Singapore (SG)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/299,543

(22) Filed: Jun. 9, 2014

(65) Prior Publication Data

US 2014/0368102 A1 Dec. 18, 2014

(30) Foreign Application Priority Data

Jun. 14, 2013 (EP) ..... 13172051

(51) Int. Cl.

| | |
|---|---|
| ***G07F 19/00*** | (2006.01) |
| ***G07D 11/00*** | (2006.01) |
| ***A47B 81/00*** | (2006.01) |
| ***E05G 1/026*** | (2006.01) |
| ***E05G 1/06*** | (2006.01) |
| ***E05G 7/00*** | (2006.01) |

(52) U.S. Cl.

CPC ..... *G07F 19/205* (2013.01); *G07D 11/0009* (2013.01); *A47B 81/00* (2013.01); *E05G 1/026* (2013.01); *E05G 1/06* (2013.01); *E05G 7/001* (2013.01); *G07F 19/201* (2013.01)

(58) Field of Classification Search

USPC ..... 235/7 R, 379

See application file for complete search history.

(56) References Cited

U.S. PATENT DOCUMENTS

| | | | | |
|---|---|---|---|---|
| 4,087,929 | A * | 5/1978 | Ruger | 40/488 |
| 8,485,432 | B2 | 7/2013 | Holland-Letz et al. | |
| 2002/0003163 | A1 * | 1/2002 | Peebles et al. | 235/379 |
| 2011/0155736 | A1 | 6/2011 | Berendes | |
| 2012/0261876 | A1 * | 10/2012 | Berendes | 271/18 |

FOREIGN PATENT DOCUMENTS

| | | | |
|---|---|---|---|
| DE | 102008018935 | A1 | 10/2009 |
| EP | 2541516 | A2 | 1/2013 |
| GB | 2039264 | A | 8/1980 |

OTHER PUBLICATIONS

Search Report for Application No. EP13172051.8 dated Nov. 25, 2013.

* cited by examiner

*Primary Examiner* — Allyson Trail

(74) *Attorney, Agent, or Firm* — Harness, Dickey & Pierce, P.L.C.

(57) ABSTRACT

The invention relates to a cash box (10) which comprises a housing (12) with an opening (16) for supplying notes of value to a storing compartment for storing notes of value and/or for removing notes of value from the storing compartment. Moreover, the cash box (10) has a closing unit (18) that comprises a jalousie part (32) and a plate-shaped part (34). The plate-shaped part (34) has a first engaging element (38) which is shaped in such a manner that, when the cash box (10) is being inserted in a device (102) for handling notes of value, the first engaging element (38) engages with the second engaging element (126) of the device (102) so that the closing unit is moved from a closing position to an open position. Moreover, the invention relates to a device (102) for handling notes of value.

12 Claims, 8 Drawing Sheets

CASH BOX WITH A PARTIALLY PLATE-SHAPED CLOSING UNIT AND DEVICE FOR HANDLING NOTES OF VALUE

CROSS REFERENCE TO RELATED APPLICATION

This application claims priority to European patent application No. EP 13172051.8 filed Jun. 14, 2013 which is hereby incorporated by reference.

BACKGROUND OF THE INVENTION

1. Field of Invention

The invention relates to a cash box which comprises a housing with an opening for supplying notes of value to a storing compartment for storing notes of value and for removing notes of value from the storing compartment. Moreover, the cash box has a closing unit which closes the opening when it is arranged in a closing position. When the closing unit is arranged in open position, notes of value can be supplied to the storing compartment and/or removed from the storing compartment. The closing unit is arranged in such a manner that it is slideable between the open position and the closing position along a predetermined path. Moreover, the invention relates to a device for handling notes of value which comprises a storing compartment for storing a cash box. When the cash box is being inserted into the storing compartment notes of value can be supplied to the cash box and removed from the cash box by means of a stacking and separating module of the device.

2. Discussion

Document DE 10 2008 018935 A1 describes a cash box with an opening through which notes of value can automatically be supplied to the cash box and automatically be removed from the cash box. The cash box has a jalousie-shaped shutter which closes this opening in a closing position and which grants access to the notes of value inside the cash box when it is arranged in an open position. One of the lamellae of the shutter has a cavity in which a complementary-shaped protrusion of the chassis of an automated teller machine or another device for handling notes of value engages when the cash box is inserted into a storing compartment of the automated teller machine or this device for handling notes of value. The shutter is moved from the closing position to the open position by this engagement when the box is being inserted into the device and, inversely, moved from the open position into a closing position when the cash box is pulled out of the device.

This opening and closing mechanism has the disadvantage that the shutter is preferred to be moved along a path with a relatively large radius to ensure safe engagement between the cavity and the protrusion, so that a reliable opening and closing of the shutter is achieved. Moreover, this mechanism has the disadvantage that the shutter can easily get stuck which causes uncomfortable handling.

Further cash boxes with a jalousie-shaped shutter are described in documents EP 0172953 A1 and JP 2008 171334 A.

SUMMARY OF THE INVENTION

It is an object of the invention to specify a cash box and a device for handling notes of value that enable a reliable and comfortable closing and opening of a closing unit of the cash box.

According to an aspect of the invention the closing unit comprises a jalousie part and a plate-shaped part connected with the jalousie part. The plate-shaped part has a first engaging element which is shaped and arranged in such a manner that, when the cash box is being inserted into a device for handling notes of value, the first engaging element engages with the second engaging element of the device for handling notes of value so that the closing unit is being moved from the closing position to the open position due to the engagement of the first and the second engaging element while inserting the cash box into a storing compartment of the device for handling notes of value. By constructing a part of the closing unit plate-shaped and by providing a first engaging element on this plate-shaped part, a reliable engagement between the first and the second engaging element is achieved. Moreover, the friction between the closing unit and the guide elements, by means of which the closing unit is guided when it is moved between the closing position and the open position, is reduced so that the force necessary to move the closing unit is decreased. Hereby, the cash box can be inserted into the device for handling notes of value and/or removed from the device for handling notes of value in a very comfortable manner and the whole handling is eased.

The device for handling notes of value can in particular be an automated teller machine, an automatic cash register system, and/or an automatic cash safe. The notes of value are especially notes of value.

The first engaging element is particularly constructed as a protrusion on the surface of the plate-shaped part. The first engaging element, in particular, engages that surface of the plate-shaped part which is opposite to the surface of the plate-shaped part which faces the inner side of the cash box. The second engaging element is especially also constructed as a protrusion which protrudes into the storing compartment for storing the cash box. When inserting the cash box into the storing compartment the protrusion of the device and the protrusion of the plate-shaped part of the closing unit of the cash box contact each other whereby the closing unit is held whereas the rest of the cash box is moved further in the inserting direction in which the cash box is inserted into the storing compartment. By means of this, the closing unit is moved from the closing position to the open position, so that notes of value can be supplied to the cash box and/or be removed from the cash box through the opening of the cash box by means of a stacking and/or separating module of the device for handling notes of value. Moreover, this mechanism by means of which the closing unit is automatically opened ensures that the opening cannot be forgotten as it might be the case if the closing unit had to be opened manually.

The jalousie part comprises in particular a plurality of lamellae connected jointed with each other. The dimension of the plate-shaped part in the moving direction of the closing unit is in a range between 5 and 20 times, in particular between 10 and 15 times, of the dimension of one lamella of the jalousie part in the moving direction.

The plate-shaped part is especially made of one piece so that it can be manufactured easily and cheaply.

In a preferred embodiment, the closing unit comprises a third engaging element which is pivotably mounted on the plate-shaped part and which is shaped in such a manner that it engages with the second engaging element of the device for handling notes of value when the cash box is removed from the device for handling notes of value so that the closing unit is moved from the open position to the closing position due to the engagement of the third engaging element and the second engaging element. By this mechanism it is achieved that the closing unit is automatically moved from the open position to the closing position when the cash box is being removed from the device for handling notes of value.

Preferably, the third engaging element is pivotable between the engaging position and an inserting position. In the engaging position, the third engaging element is arranged such that it engages with the second engaging element of the device for handling notes of value, at least when the cash box is being removed from the device for handling notes of value. When the third engaging element is arranged in the inserting position, it allows the second element to be inserted in an area between the first engaging element and the third engaging element. Therefore, the second engaging element can be arranged in this area between the first engaging element and the third engaging element when the cash box is being inserted into the device for handling notes of value and is surrounded by the first and the third engaging element when the cash box is at least partially arranged in the storing compartment of the device.

The third engaging element contacts the second engaging element at least when the cash box is moved in a removing direction which is reverse to the inserting direction. In a preferred embodiment, the third engaging element also contacts the second engaging element when it is arranged in the engaging position and when the cash box is being moved in the inserting direction while inserting the cassette into the storing compartment. Alternatively, it is also possible that there is a gap between the third and the second engaging element when the third engaging element is arranged in the engaging position and when the cash box is being moved in the inserting direction. When the moving direction is reversed from the inserting direction to the removing direction, this gap is closed so that the third and the second engaging elements engage with each other so that the closing unit is held in its current position, and the closing unit is moved from the open position to the closing position, when the cash box is being removed.

Preferably, the first engaging element and the third engaging element contact the second engaging element and opposite sides when the cash box is inserted in the device for handling notes of value and when the third engaging element is arranged in the engaging position. The third engaging element is pivoted by an angle between 30° and 120° relatively to the inserting position when it is arranged in the engaging position. In a preferred embodiment, the third engaging element is pivoted by an angle between 80° and 100° between the two mentioned positions.

Advantageously, the third engaging element is mounted to the plate-shaped part at the inner side of the plate-shaped part. The inner side of the plate-shaped part is the side which faces the inner space of the cash box. The plate-shaped part has a cavity through which at least a section of the third engaging element protrudes when the third engaging element is arranged in the engaging position. The section protruding through the cavity forms a protrusion which projects from the outer surface of the plate-shaped part. This protrusion engages with the second engaging element, so that the closing unit is held by this engagement when the cash box is removed from the device for handling notes of value. Hereby, the closing unit is moved from the open position to the closing position so that access to the notes of value stored in the storing compartment of the cash box is possible.

In a preferred embodiment, the third engaging element is arranged in the inserting position when the closing unit is arranged in the closed position and arranged in the engaging position when the closing unit is arranged in the open position. When the cash box is arranged outside the device for handling notes, the closing unit is in the closing position and the third engaging element is in the inserting position, so that the second engaging element can be arranged in the area between the third and the second engaging elements. The closing unit is in the open position when the cash box is inserted in the device for handling notes of value. As in this case the third engaging element is positioned in the engaging position the closing unit is moved back in the closing position when removing the cash box.

In a preferred embodiment, the third engaging element is biased in the inserting position by means of a biasing element. This biasing element is in particular a spring, especially a torsion spring.

Advantageously, the third engaging element contacts the contact area element of the cash box when the closing unit is moved from the closing position to the open position. Due to this contact, the third engaging element is pivoted from the inserting position to the engaging position against the force of the biasing element. Hereby, the third engaging element is automatically moved from the inserting position to the engaging position when the cash box is being inserted into a storing compartment of a device for handling notes of value. This has the consequence that it is ensured that the closing unit is closed when the cash box is extracted from the device for handling notes of value.

In a preferred embodiment, the third engaging element is held in the engaging position by the contact of the third engaging element and a contact area until the closing unit is again arranged in the closing position. Alternatively, the third engaging element can also be held in the engaging position by contacting another stationary element of the cash box.

The stationary element can be every part of the cash box that is not moved together with the closing unit when the closing unit is moved between the closed and the open position.

Preferably, the third engaging element is L-shaped or T-shaped so that engaging and disengaging with the third engaging element can easily be realized by pivoting the L-shaped or T-shaped third engaging element by approximately 90°.

Another aspect of the invention relates to a device for handling notes of value which comprises a storing compartment for storing a cash box according to the preceding description. The device comprises a second engaging element arranged on a chassis of the storing compartment. The second engaging element is shaped and arranged in such a manner that it engages with the first engaging element of the cash box when the cash box is being inserted in the storing compartment, so that the closing unit of the cash box is moved from the closing position to the open position while inserting the cash box in the storing compartment of the device for handling notes of value.

The device for handling notes of value can in particular be an automated teller machine, a point of sale, an automatic cash register system or an automatic cash safe. In a preferred embodiment the cash box is inserted in the storing compartment of the device for handling notes of value.

BRIEF DESCRIPTION OF THE DRAWINGS

Further features and advantages of the invention result from the following description which, in connection with the enclosed Figures, explains the invention in more detail with reference to embodiments.

DESCRIPTION OF THE PREFERRED EMBODIMENTS

Figure 1:
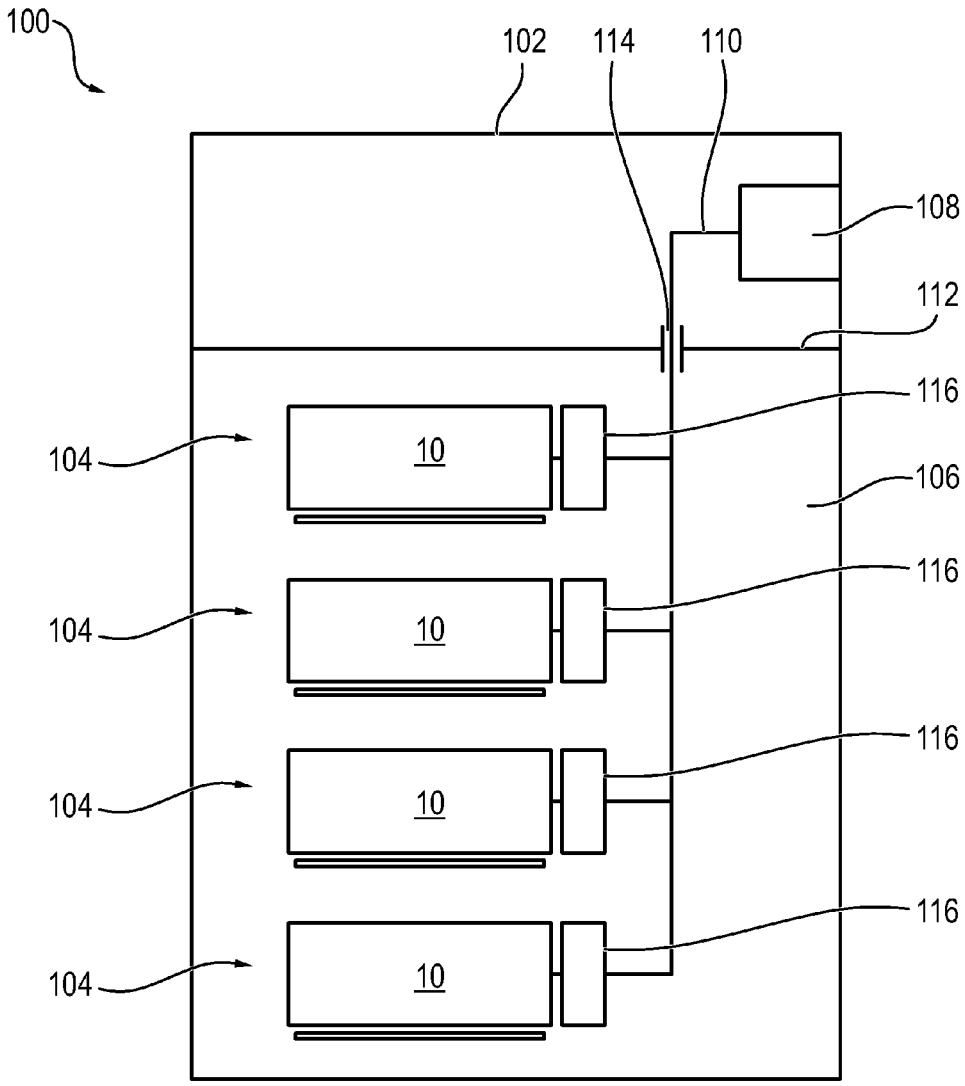
FIG. 1 shows a schematic illustration of an assembly comprising an automated teller machine and four cash boxes.

FIG. 1 shows a schematic illustration of an assembly 100 comprising an automated teller machine 102 and four cash boxes 10. The automated teller machine 104 has four storing compartments 104 for receiving one cash box each. In an alternative embodiment, the automated teller machine 102 can also comprise more than four storing compartments 104 or less than four storing compartments 104. In a further alternative embodiment, the cash boxes 10 can also be inserted in another device for handling notes of value, e.g. a point of sale, an automatic cash safe, or an automatic cash system.

The automated teller machine 102 comprises a safe 106 in which the storing compartments 104 are arranged so that access to the inserted cash boxes 10 by an unauthorized person is avoided.

Moreover, the automated teller machine 102 comprises an input and output unit 108 for inserting and dispensing notes of value. The notes of value are transported between the input and output unit 108 and the cash boxes 10 along a predetermined transport path 110. The wall 112 of the safe 106 comprises a gap 114 through which the notes of value can be transported. Each storing compartment 104 has a dedicated stacking and separating module 116 by means of which notes of value can be supplied to and be removed from a cash box 10 arranged in the according storing compartment 104.

Figure 2:
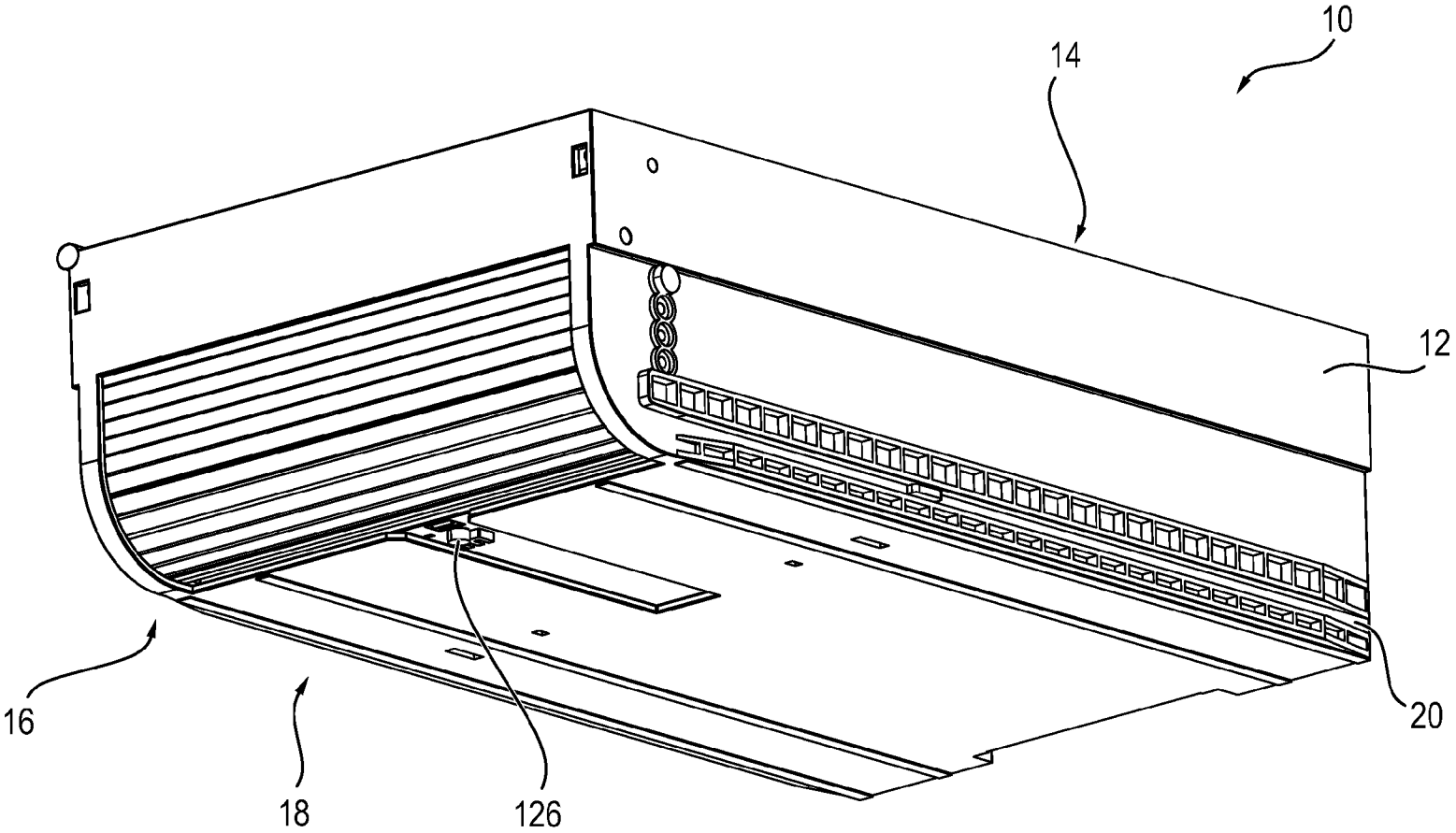
FIG. 2 shows a perspective, schematic illustration of a cash box.

FIG. 2 shows a perspective, schematic illustration of a cash box 10. The cash box 10 has a housing 12 wherein in FIG. 2 a cover of the housing for closing an opening 14, through which a manual access to the inner units of the cash box 10 and to the notes of value arranged in the cash box 10 is possible, is not shown in order to simplify the illustration. The housing 12 has a further opening 16, through which notes of value can automatically be supplied to the cash box 10 and be removed from the cash box 10 by a stacking and separating module 116 when the cash box 10 is inserted in the automated teller machine 102 or another device for handling notes of value.

The cash box 10 comprises a closing unit 18 for closing this opening 16. In FIG. 2 the closing unit 18 is arranged in a closing position in which it closes the opening 16 completely. In an open position shown in FIG. 9 the closing unit 18 is arranged is such a manner that the opening 16 is open so that notes of value can be transported through it.

Figure 3:
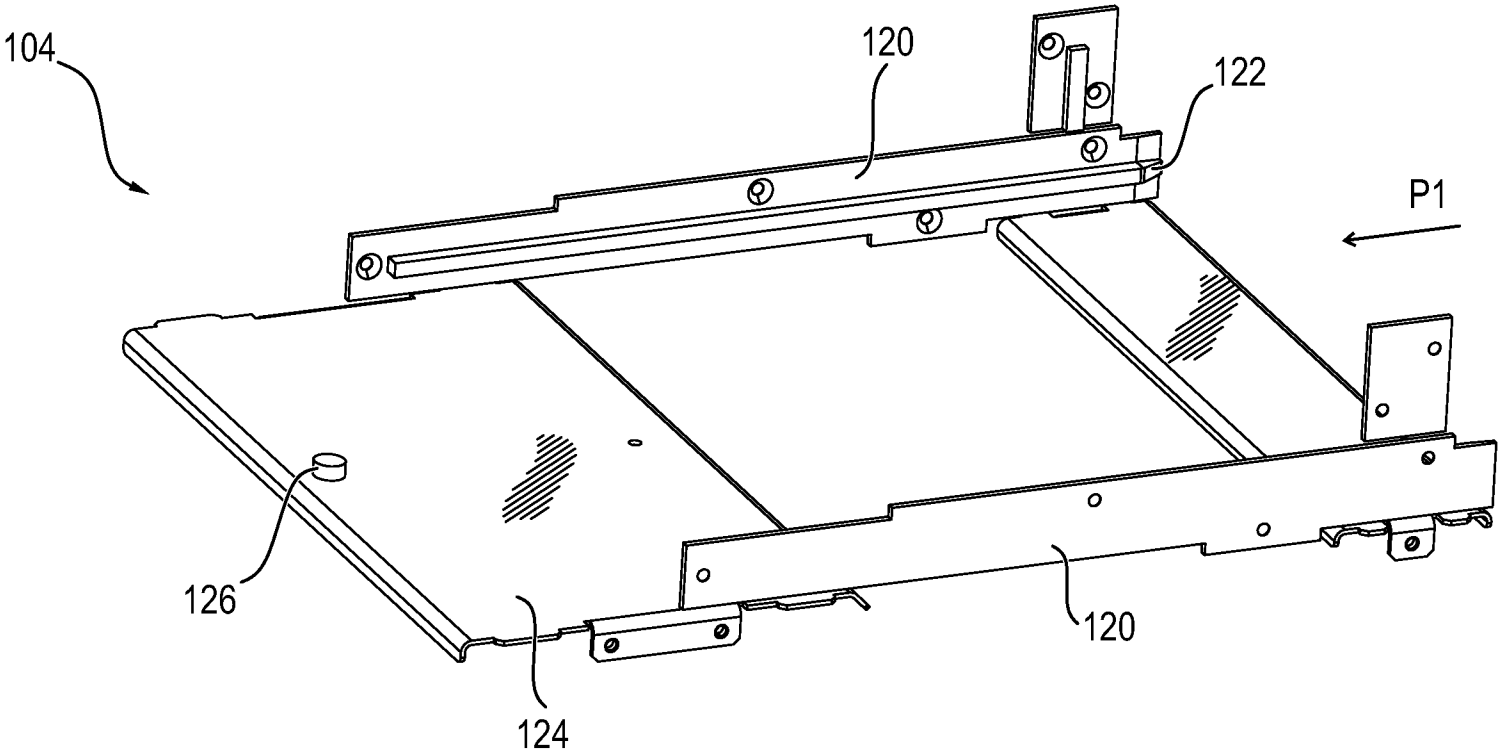
FIG. 3 shows a schematic, perspective illustration of the chassis of a storing compartment for storing a cash box of the automated teller machine according to FIG. 1.

FIG. 3 shows a perspective, schematic illustration of a detail of the chassis of one of the storing compartments 104. On the sides of the storing compartment 104 two support elements 120 are provided. Each support element 120 has a protrusion 122 which engages with the complementary cavity 120 of the cash box 10 when the cash box 10 is being inserted in the storing compartment 104. By this engagement the cash box 10 is held in a predetermined position relatively to the storing compartment 104.

Figure 4:
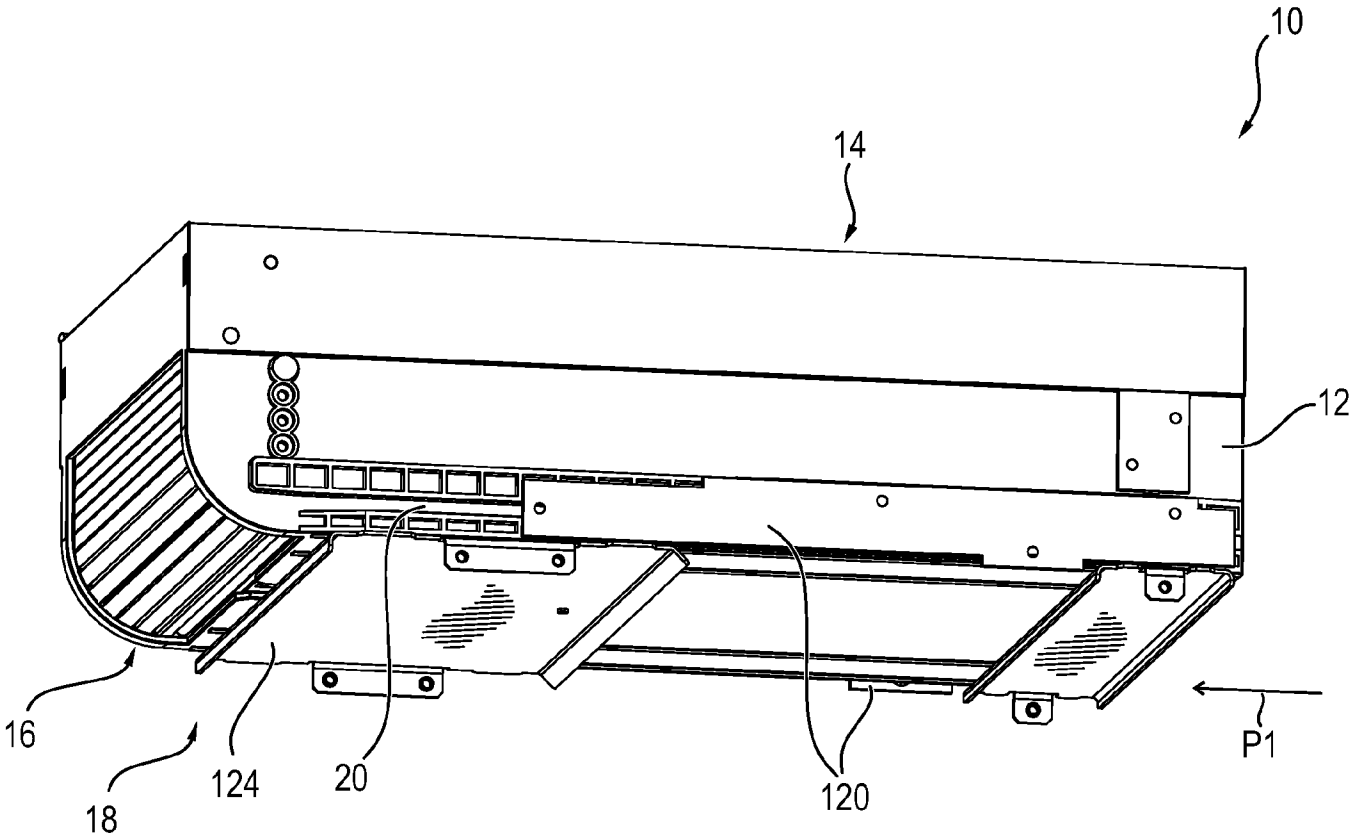
FIG. 4 shows a schematic, perspective illustration of the cash box according to FIG. 2 and the chassis according to FIG. 3 in an inserted state.

On a bottom unit 124 of the chassis a second engaging element 126 is arranged which, as described in reference with the following Figures, is used in order to hold the closing unit 18 of the cash box 10 when the cash box is being inserted and to close the unit 18 when the cash box 10 is being removed from the storing compartment 104. The cash box 10 is being inserted in the inserting compartment 104 in an inserting direction P1. FIG. 4 shows an illustration of the cash box 10 inserted in the chassis of the storing compartment 104.

Figure 5:
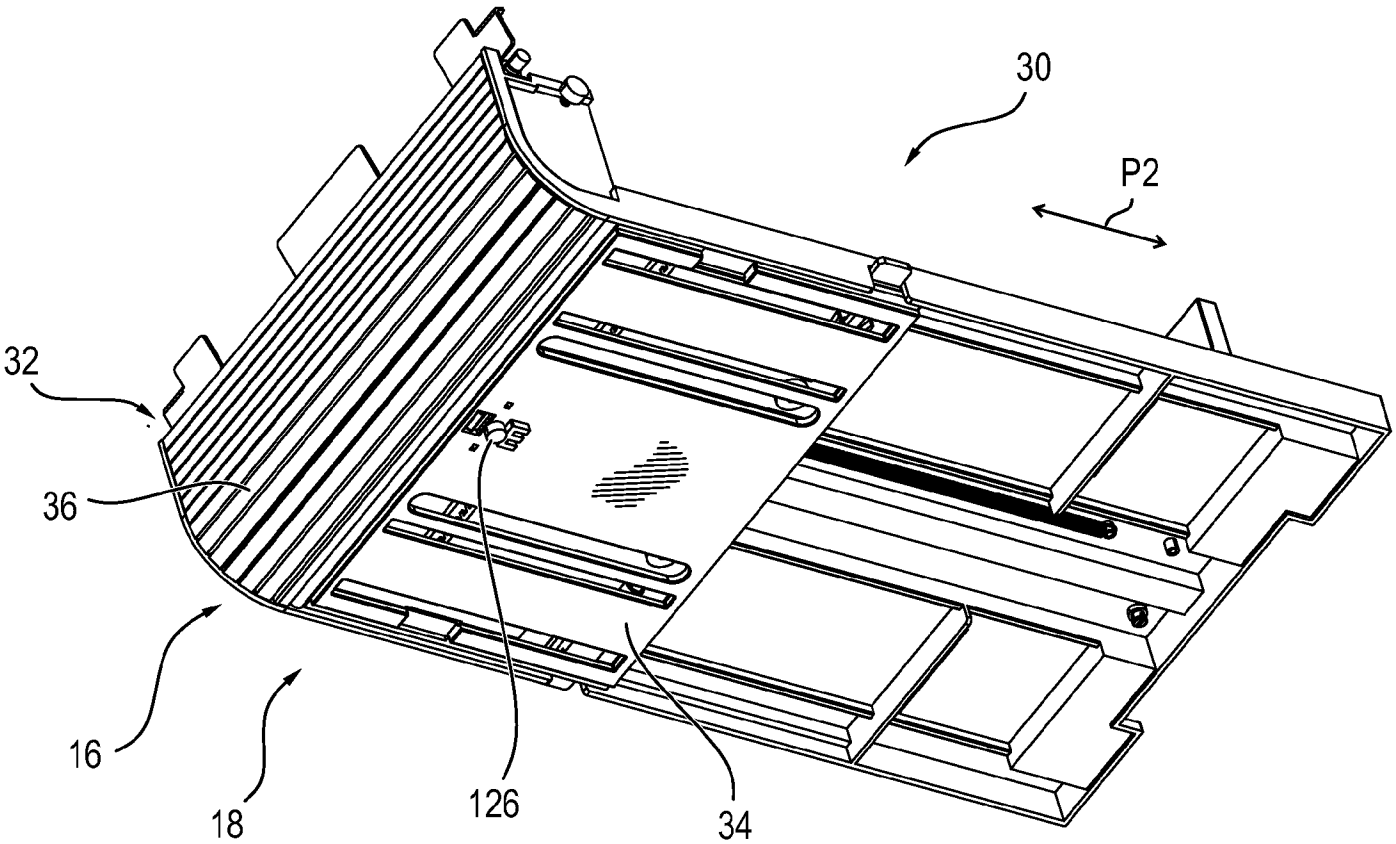
FIG. 5 shows a perspective, schematic illustration of a bottom unit of the cash box according to FIG. 2.

FIG. 5 shows a perspective, schematic illustration of a bottom unit 30 of the cash box 10. The housing 12 is not shown in order to illustrate the inner assembly of the cash box 10.

The closing unit 18 comprises a jalousie part 32 and a plate-shaped part 34 which are jointed to each other. The jalousie part 32 comprises a plurality of lamellae 36 which close the curved part of the opening 16 in the closing position of the closing unit 18. The jalousie part 32 and the plate-shaped part 34 are connected permanently with each other so that they are moved together in both directions of the double-arrow P2 while closing or opening the closing unit 18.

The plate-shaped part 34 has a first engaging element 38 which engages with the second engaging element 126 when the cash box 10 is being inserted into the storing compartment 104. By contact between the first engaging element 38 and the second engaging element 126 the closing unit 18 is held, wherein the rest of the cash box 10 is moved further in the inserting direction P1 so that the closing unit 18 is automatically moved from the closing position to the open position.

Figure 6:
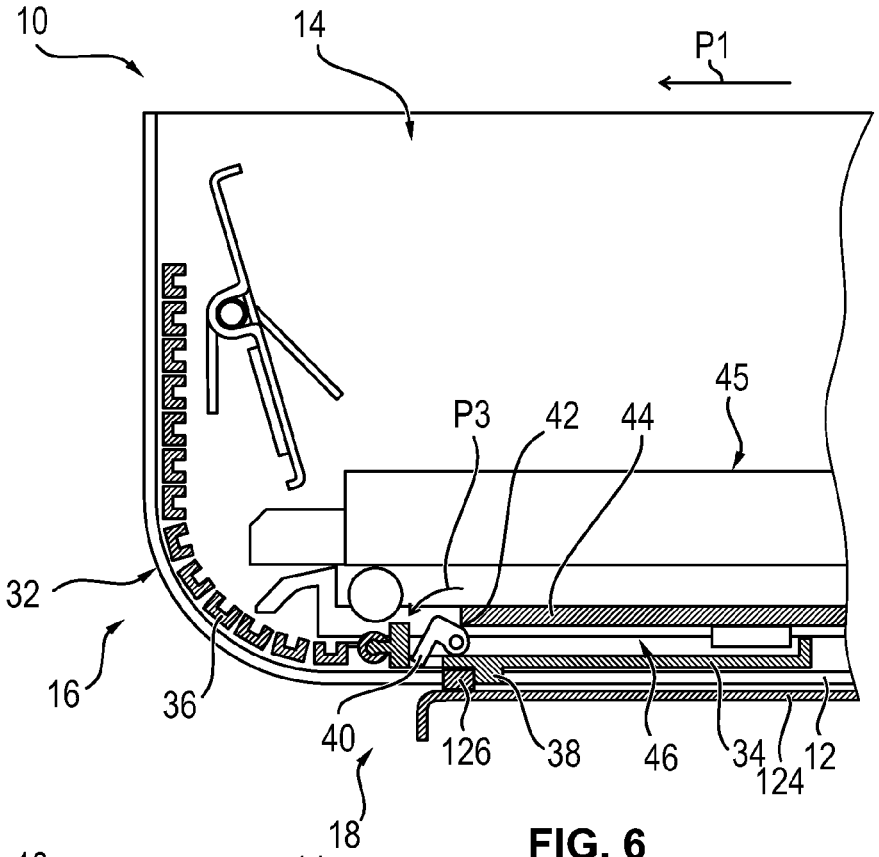
FIG. 6 shows a sectional view of a detail of the cash box according to FIG. 2.

As shown in FIG. 6, the closing unit 18 comprises a third engaging element 40 which is mounted pivotably on the inner side 42 of the plate-shaped part of the closing unit 18. In an alternative embodiment, the third engaging element 40 can also have every other shape different from the L-shaped form.

Figure 7:
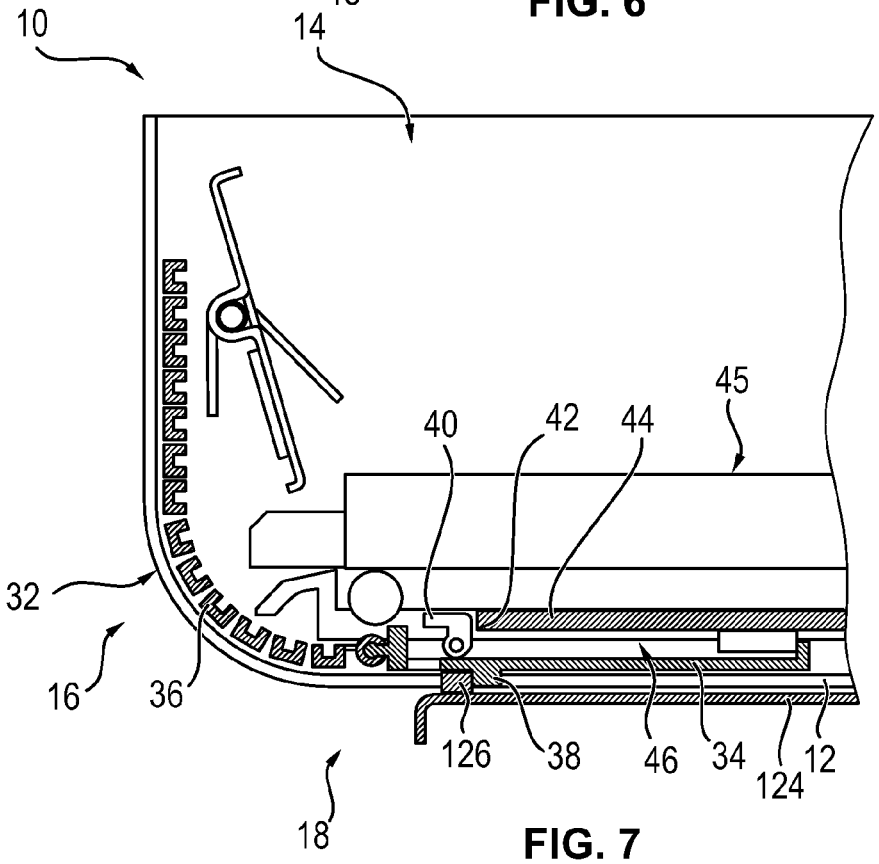
FIG. 7 shows a further sectional view of the cash box according to FIG. 2 in a first state.

FIG. 7 shows a sectional view of the cash box 10 in a first state in which the cash box 10 has not yet been shifted into the storing compartment 104. In this first state the closing unit 18 is arranged in the closed position and the third engaging element 40 is arranged in an inserting position in which it is biased by means of a not shown torsion spring. In an alternative embodiment it is also possible that other biasing elements are used instead of a torsion spring. When the cash box 10 is moved into the storing compartment 104 in the inserting direction P1, the closing unit 18 is moved in the direction indicated by arrow P2. Hereby, the third engaging element 40 contacts the edge of a stationary element 44 of bottom unit 30 of the cash box 10 which is not moved together with the closing unit 18. By this contact the engaging element 40 is pivoted in a pivoting direction P3 until it is arranged in an engaging position shown in FIG. 8. In this engaging position the second engaging element 126 of the chassis of the storing compartment 104 is surrounded by the third engaging element 40 and the first engaging element 38.

When the closing unit 18 is moved further towards the open position, the third engaging element is held in the engaging position due to a contact between a contact area 46 of the stationary element 44 and the third engaging element 40.

Figure 8:
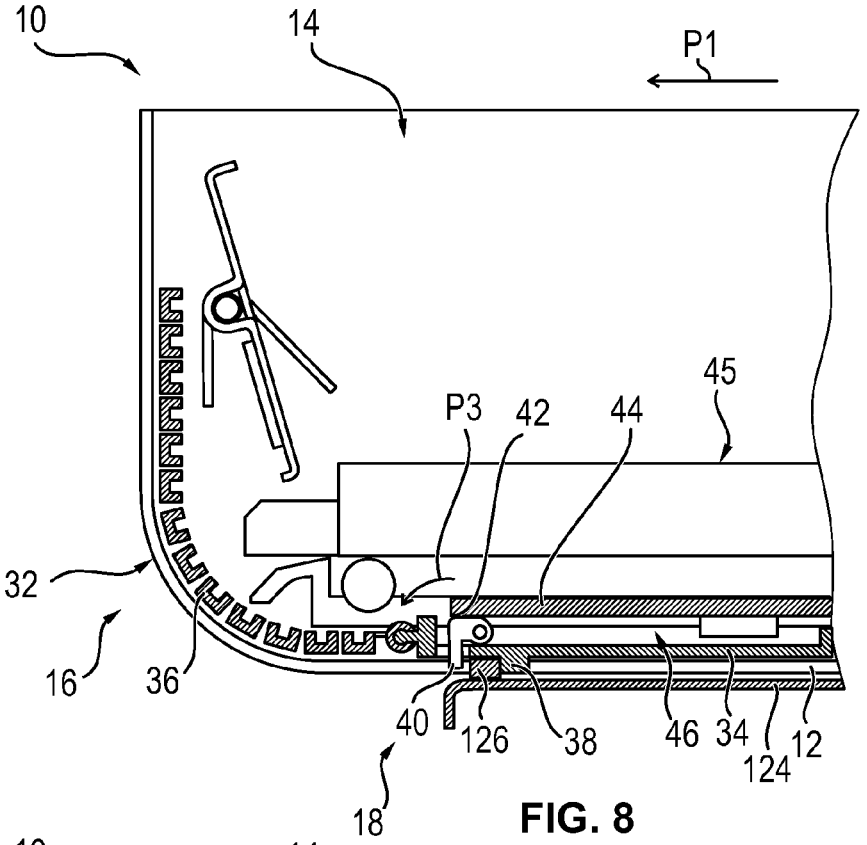
FIG. 8 shows a sectional view of the cash box according to FIG. 2 in a second state.

FIG. 8 shows a second state in which the closing unit 18 is arranged in an intermediate state between the closed position and the open position.

Figure 9:
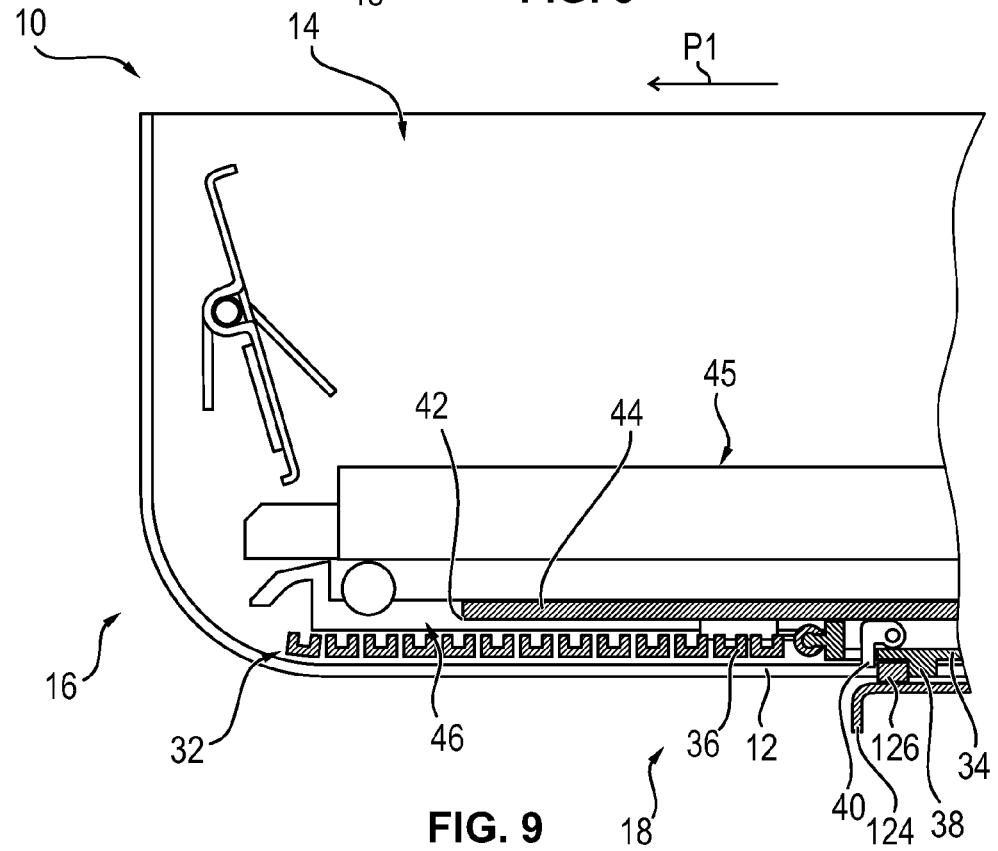
FIG. 9 shows a sectional view of the cash box according to FIG. 2 in a third state.

FIG. 9 shows a sectional view of the cash box in a third state in which the closing unit 18 is arranged in the open position. When the cash box 10 is now removed from the storing compartment 104, the closing unit 18 is moved back from the open position to the closing position due to the contact of the second engaging element 126 and the third engaging element 40. When the closing unit 18 is again arranged in the closing position, the third engaging element 40 does not contact the stationary element 44 any longer and the spring force of the torsion spring moves the third engaging element 40 back from the engaging position to the inserting position. Hereby, the cash box 10 can be removed from the storing compartment 104 and be inserted in another storing compartment 104.

By means of the aforesaid closing unit and engaging mechanism it is achieved that the closing unit can be opened and closed in a very comfortable manner and only little force is needed. Moreover, it is ensured that the closing unit 18 is opened and closed automatically in a reliable manner.

Figure 10:
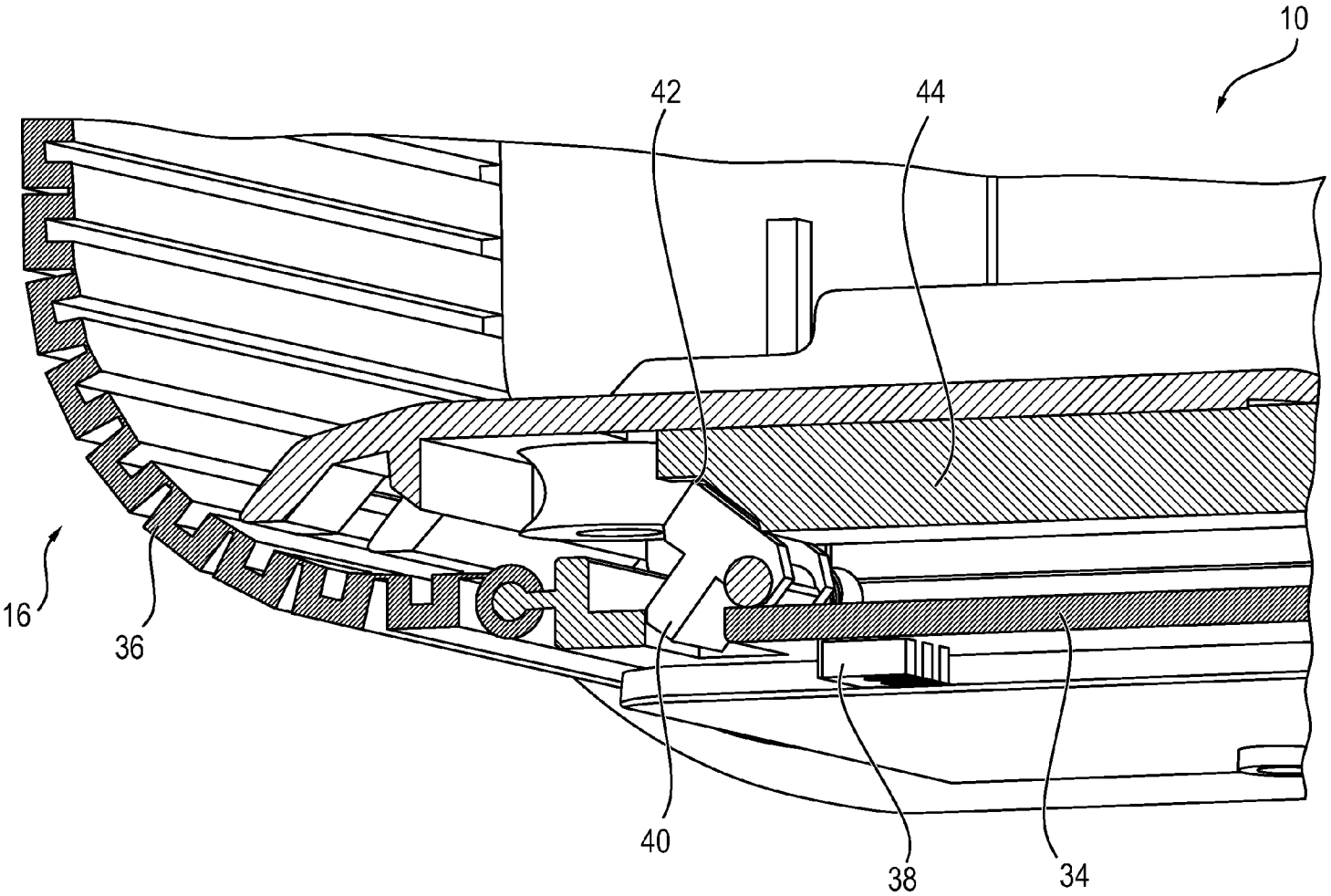
FIG. 10 shows a sectional view of a part of a cash box according to a further embodiment.

FIG. 10 shows a sectional view of a part of a cash box 10 according to a further embodiment. Elements with the same structure or function are identified with the same reference signs as in the preceding figures.

The main difference between the embodiment of FIG. 10 and the previous embodiment shown in FIGS. 2 to 9 is that the third engaging 40 is T-shaped in the embodiment of FIG. 10 instead of L-shaped. The function of the closing and opening mechanism of the closing unit 18, especially the engaging between the third engaging element 40 and the first and second engaging elements 38, 126, is the same as in the embodiment described in connection with FIGS. 2 to 9.

The advantage of the T-shaped third engaging element 40 compared to the L-shaped engaging element 40 is that the friction between the third engaging element and the elements which are contacted by the third engaging element 40, when the cash box 10 is being inserted into the storing compartment 104, is reduced. In particular, the friction between the third engaging element 40 and the stationary element 44 is minimized so that the cash box 10 can be inserted and removed easily.

The edge 42 of the stationary element 44 which is contacted by the third engaging element 40 in order to pivot the third engaging element 40 is preferably beveled. Thereby the forces acting between the third engaging element 40 and the stationary element 44 are reduced even further.

What is claimed is:

1. A cash box comprising:

a housing with an opening for supplying notes of value to a storing compartment for storing notes of value and/or for removing notes of value from the storing compartment, and a closing unit which closes the opening, when it is arranged in a closing position, and which grants access to the notes of value stored in the storing compartment, when it is arranged in an open position, wherein the closing unit is slidable between the open position and the closing position along a predetermined path, wherein the closing unit includes a jalousie part and a plate-shaped part connected with the jalousie part, and wherein the plate-shaped part includes a first engaging element which is shaped and arranged in such a manner that, when the cash box is being inserted in a device for handling notes of value, the first engaging element engages with a second engaging element of the device for handling notes of value so that the closing unit is moved from the closing position to the open position due to the engagement of the first engaging element and the second engaging element while inserting the cash box;

wherein the closing unit comprises a third engaging element which is pivotably mounted on the slate-shared part and which is shaped in such a manner that it engages with the second engaging element of the device for handling notes of value when the cash box is being removed from the device for handling notes of value so that the closing unit is moved from the open position to the closing position due to the engagement of the third engaging element and the second engaging element while removing the cash box; and wherein the third engaging element pivotable between an engaging position in which it engages with the second engaging element and an inserting position in which the third engaging element is arranged in such a manner that the second engaging element can be arranged in an area between the first engaging element and the third engaging element when the cash box is inserted in the device for handling notes of value.

2. The cash box according the claim 1, wherein the first engaging element is constructed as a protrusion on the surface of the plate-shaped part.

3. The cash box according to claim 1, wherein the jalousie part comprises a plurality of lamellae jointed with each other.

4. The cash box according to claim 3, wherein the dimension of the plate-shaped part in the moving direction of the closing unit is between 3 and 15 times of the dimension of one lamella of the jalousie part in the moving direction.

5. The cash box according to claim 1, wherein the plate-shaped part is made of one piece.

6. The cash box according to claim 1, wherein the first engaging element and the third engaging element contact the second engaging element on opposite sides when the cash box is inserted in the device for handling notes of value and when the third engaging element is arranged in the engaging position.

7. The cash box according to claim 1, wherein in the engaging position the third engaging element is pivoted by an angle between 30° and 120° relatively to the inserting position.

8. The cash box according to claim 1 wherein the third engaging element is mounted on the plate-shaped part on the inner side of the plate-shaped part that the plate-shaped part has a cavity through which at least a section of the third engaging element protrudes when the third engaging element is arranged in the engaging position.

9. The cash box according to claim 1 wherein the third engaging element is arranged in the inserting position when the closing unit is arranged in the closed position, and that the third engaging element is arranged in the engaging position when the closing unit is arranged in the open position, especially when the closing unit is arranged in any other position different from the closing position.

10. The cash box according to claim 1, wherein the third engaging element is biased in the inserting position by means of a biasing element, especially by means of a torsion spring.

11. The cash box according to claim 10, wherein when the closing unit is moved from the closing position to the open position, the third engaging element contacts a contact area of a stationary element of the cash box, that the third engaging element is pivoted from the inserting position to the engaging position against the force of the biasing element by the contact of the third engaging element and the contact area, and that the third engaging element is held in the engaging position by the contact of the third engaging element and the contact area until the closing unit is again arranged in the closing position.

12. The cash box according to one of claim 1, wherein the third engaging element is L-shaped or T-shaped.

* * * * *